US008113604B2

(12) United States Patent
Olson et al.

(10) Patent No.: US 8,113,604 B2
(45) Date of Patent: Feb. 14, 2012

(54) MODULAR INSULATION SYSTEM FOR AN ENVIRONMENTALLY CONTROLLED CABINET

(75) Inventors: Jeffrey C. Olson, Dallas, PA (US); James L. Kilgallon, Forty Fort, PA (US); Willard J. Sickles, Dalton, PA (US); David A. Reppert, Kingston, PA (US)

(73) Assignee: Metro Industries, Incorporated, Reno, NV (US)

( * ) Notice: Subject to any disclaimer, the term of this patent is extended or adjusted under 35 U.S.C. 154(b) by 435 days.

(21) Appl. No.: 12/122,398

(22) Filed: May 16, 2008

(65) Prior Publication Data

US 2008/0284302 A1 Nov. 20, 2008

Related U.S. Application Data

(60) Provisional application No. 60/939,024, filed on May 18, 2007.

(51) Int. Cl.
*A47B 77/08* (2006.01)

(52) U.S. Cl. ..... 312/236; 312/400; 312/263; 312/265.5

(58) Field of Classification Search ..... 312/400, 312/236, 265.1–265.6, 263, 409; 52/506.01–506.04, 52/309.8–309.9; 126/246, 261, 268
See application file for complete search history.

(56) References Cited

U.S. PATENT DOCUMENTS

| | | | | |
|---|---|---|---|---|
| 3,078,003 | A * | 2/1963 | Kesling | 220/592.1 |
| 4,973,109 | A * | 11/1990 | Diedrich | 312/265.6 |
| 5,044,705 | A * | 9/1991 | Nelson | 312/400 |
| 5,704,699 | A * | 1/1998 | Pagelow et al. | 312/265.3 |
| 5,875,599 | A | 3/1999 | McGrath et al. | |
| 5,957,557 | A * | 9/1999 | Langer et al. | 312/236 |
| 6,012,790 | A * | 1/2000 | Thomas et al. | 312/265.5 |
| 6,124,572 | A | 9/2000 | Spilger et al. | |
| 6,185,878 | B1 * | 2/2001 | Bullard et al. | 312/263 |
| 6,359,217 | B1 * | 3/2002 | Thompson et al. | 312/223.6 |
| 6,415,623 | B1 * | 7/2002 | Jennings et al. | 62/457.2 |
| 6,418,282 | B1 | 7/2002 | Ayash et al. | |
| 6,425,649 | B2 * | 7/2002 | Kasuya | 312/409 |
| 6,460,955 | B1 * | 10/2002 | Vaughan et al. | 312/401 |
| 7,748,797 | B2 * | 7/2010 | Cleveland et al. | 312/257.1 |
| 2006/0032491 | A1 | 2/2006 | Olson et al. | |
| 2006/0108899 | A1 | 5/2006 | Jin | |

FOREIGN PATENT DOCUMENTS

| | | | |
|---|---|---|---|
| CN | 2895593 | Y | 5/2007 |
| JP | 54122461 | * | 9/1979 |
| JP | 2003233864 | * | 8/2003 |

OTHER PUBLICATIONS

Chinese Office Action dated Sep. 15, 2011 in corresponding Chinese Patent Application No. 200880024478.0.

* cited by examiner

*Primary Examiner* — Hanh V Tran
(74) *Attorney, Agent, or Firm* — Fitzpatrick, Cella, Harper & Scinto

(57) ABSTRACT

A modular insulation panel provides insulation to a cabinet having lateral side walls, a back wall and a top wall. A main panel assembly insulates a lateral side wall, wherein the main panel assembly includes a framed double wall structure with a space therebetween for providing insulation to the lateral side wall. An auxiliary panel assembly insulates the back wall, wherein the auxiliary panel assembly includes a framed double wall structure with a space therebetween for providing insulation to the back wall. A hinge hingedly attaches the frame of the main panel assembly to the frame of the auxiliary panel assembly.

34 Claims, 9 Drawing Sheets

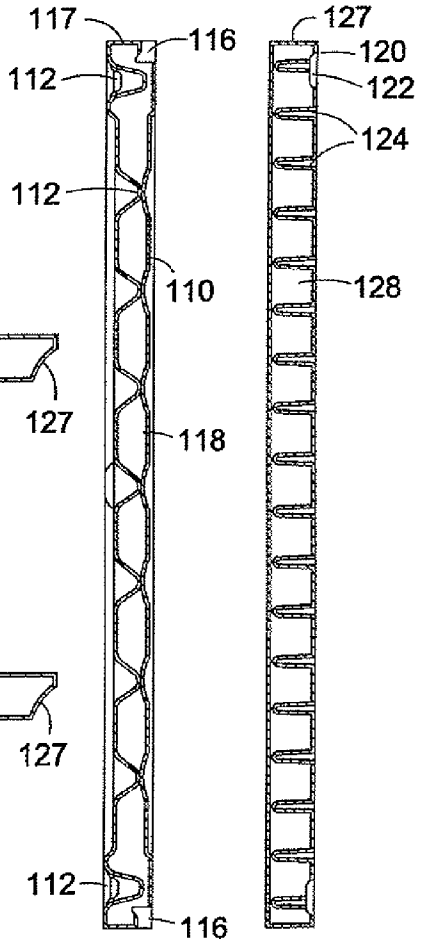
FIG. 10
FIG. 9
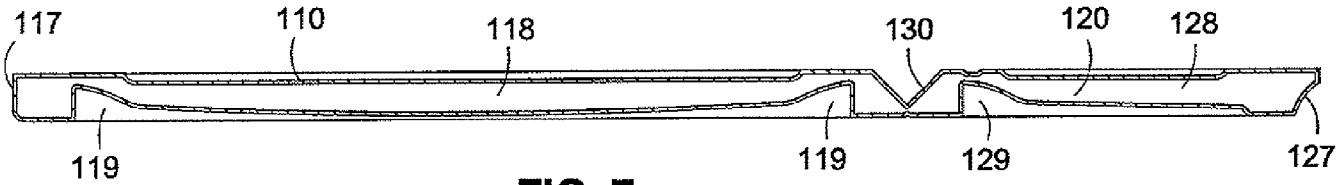
FIG. 7
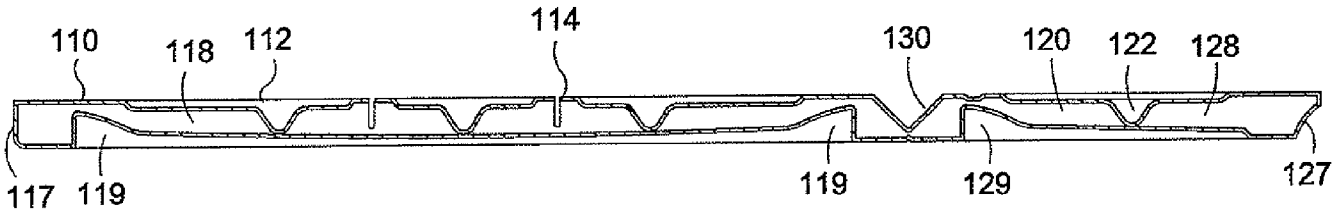
FIG. 8

MODULAR INSULATION SYSTEM FOR AN ENVIRONMENTALLY CONTROLLED CABINET

BACKGROUND OF THE INVENTION

1. Field of the Invention

This invention relates to an insulated cabinet in which insulation is provided by modular panels which are attached to the exterior of the cabinet.

2. Description of the Related Art

Food service cabinets for heating, holding or proofing food are commonly used in the food service industry, for example in eateries such as restaurants or bakeries. These cabinets can control the temperature and/or humidity within the cabinet, and may be used to cook food, to keep prepared food at a certain temperature, or to provide the necessary heat and humidity for yeast products to rise, among other functions.

Conventional food service cabinets could benefit from improvements in a number of respects. For example, a food service cabinet may commonly be manufactured from aluminum as a lightweight and inexpensive material. However, in cabinets without special provision for insulation, the insulating properties of a material such as aluminum are not ideal. Consequently, an uninsulated cabinet may suffer from heat loss, resulting in inefficient energy consumption and deterioration of food quality, such as food being served at temperatures lower than desired. In addition, inadequate insulation may result in the exterior surface of the cabinet being hotter to the touch, making usage and movement of the cabinet less practical and potentially dangerous.

Moreover, if the cabinet is not properly or adequately insulated, the cabinet loses heat or cold at a greater rate, and therefore requires more energy to maintain a given temperature. This leads to additional expense on the operator of the cabinet, in addition to negative effects on the environment.

One potential method to address this problem is simply to manufacture the cabinet with insulation already provided. Conventionally, insulated cabinets are constructed by providing fiberglass insulation between the spaced wall panels of the cabinet.

However, this method may drive up manufacturing costs and the resultant cost to the consumer, since separate manufacture is required for non-insulated and insulated cabinets. In other words, since such insulated and non-insulated cabinets do not share a common core set of components, different machinery and processes may be needed to manufacture each body of the cabinet, leading to increased cost to the consumer.

Furthermore, conventional insulation methods may not provide protection from physical damage to the cabinet. For example, a cabinet with insulation interior to the cabinet walls will still be vulnerable from scratches, dents, and other physical damage to the exterior of the cabinet, particularly in the foodservice industry, where frequent contact with other objects (such as during cleaning or movement) may occur.

SUMMARY OF THE INVENTION

The present invention addresses the foregoing by providing a cabinet with insulation panels attached to an exterior thereof, wherein the panels provide both insulation and protection to the cabinet. The panels are preferably formed in a double-wall construction with an insulating layer (such as air) therebetween, and are preferably formed of a sturdy material (such as a polyethylene or other plastic) able to withstand wear and tear that might otherwise damage an unprotected cabinet.

In one embodiment, the invention provides a modular insulation panel for insulation of a cabinet having lateral side walls, a back wall and a top wall. A main panel assembly is adapted to insulate a lateral side wall, and the main panel assembly is comprised of a framed double wall structure with a space therebetween for providing insulation to the lateral side wall. An auxiliary panel assembly is adapted to insulate the back wall, and the auxiliary panel assembly is comprised of a framed double wall structure with a space therebetween for providing insulation to the back wall. A hinge hingedly attaches the frame of the main panel assembly to the frame of the auxiliary panel assembly.

The foregoing provides an uninsulated cabinet with insulation. Moreover, the expense on the consumer may be reduced, and additional options in cabinet purchase may be made available to the consumer. It may also be possible to reduce the energy consumption of the cabinet, since the insulating walls may reduce the amount of heat (or cold) lost from the cabinet interior. Furthermore, it may be possible to replace panels in the field that are already in usage, as well as adding or subtracting panels if the consumer's needs change or if damage occurs to an original set of panels. Additionally, it may also be possible to reduce wear and tear on the cabinet walls, since the panels cover portions of the cabinet which would otherwise be exposed.

In another embodiment, the invention provides a modular insulation system, including a pair of modular insulation panels of the type described above, along with a top panel comprised of a framed double wall structure with a space therebetween for providing insulation to the top wall.

In another embodiment, a modular insulation panel is constructed for insulation of a cabinet having lateral side walls, a back wall and a top wall. A main panel assembly adapted to insulate a lateral side wall is molded, with the main panel assembly comprised of a framed double wall structure with a space therebetween for providing insulation to the lateral side wall. In addition, an auxiliary panel assembly adapted to insulate the back wall is molded, with the auxiliary panel assembly comprised of a framed double wall structure with a space therebetween for providing insulation to the back wall. A hinge is also molded for hingedly attaching the frame of the main panel assembly to the frame of the auxiliary panel assembly.

In still another embodiment, a cabinet having lateral side walls, a back wall and a top wall is insulated. A pair of modular insulation panels and a top panel are provided, wherein the top panel is integral with the first and second modular insulation panels and is comprised of a framed double wall structure with a space therebetween for providing insulation to the top wall. The respective auxiliary panel assemblies of the first and second modular insulation panels are connected to the back wall, and the top panel is connected to the top wall.

The main panel assembly may comprise plural tack-offs between the double walls for providing rigidity to the main panel. Additionally, the auxiliary panel assembly may comprise plural tack-offs between the double walls for providing rigidity to the auxiliary panel, and the top panel may comprise plural tack-offs between the double walls for providing rigidity to the top panel.

The space between the inner and outer wall of each framed double wall structure may be filled substantially with air, or the space between the inner and outer wall of each framed double wall structure may be filled at least in part by an insulative material.

The main panel assembly may cover substantially all of the lateral wall. The auxiliary panel assembly may cover substantially less than all of the back wall, and in one embodiment may cover approximately one half of the back wall.

The main panel assembly may include exterior recesses for mounting to other structures.

The hinge may be a living hinge, and the hinge may flex inwardly such that the angle between the main panel assembly and the auxiliary panel assembly is reduced. Additionally, the hinge can be constructed to bend by 90° around the lateral wall and back wall of the cabinet, and the hinge can be constructed to also lay flat. The hinge may or may not extend the full length of the interface between the lateral side wall and the back wall of the cabinet.

The modular insulation panel may include fastener bosses or other receptor mountings for receiving fasteners inserted through the cabinet to fix the modular insulation panel to the cabinet.

The modular insulation panel may be fabricated from plastic. An inner wall of each double wall structure may be made of the same material as an outer wall of the double wall structure, or an inner wall of each double wall structure may be a different material than an outer wall of the double wall structure. In one embodiment, an inner wall of each double wall structure can be comprised of a material more resistant to heat than the material of the outer wall of the double wall structure.

In another aspect, a modular insulation system may include one or more bumpers for the base of the cabinet. Each bumper may comprise a double wall structure with a space therebetween for providing insulation to the base of the lateral side wall, and plural tack-offs between the double walls for providing rigidity to the bumper.

In a modular insulation system, the frame of the main panel assembly may be integral with the face of the top panel.

The modular insulation system may include a second pair of modular insulation panels on top of a first pair modular insulation panels, for insulation of taller cabinets.

The modular insulation system may also include channel brackets which attach to the modular insulation panels.

The method of molding the modular insulation panel may be blow molding.

The cabinet may include a heating element for providing heat to the cabinet.

Additional objects, advantages, and features of the invention will become apparent to those skilled in the art upon examination of the following detailed description of preferred embodiments taken in conjunction with the accompanying drawings.

BRIEF DESCRIPTION OF THE DRAWINGS

FIG. 7 illustrates one cross-section of the modular insulation panel.

FIG. 8 illustrates another cross-section of the modular insulation panel.

FIG. 9 illustrates another cross-section of the modular insulation panel, taken from a side view of the main panel assembly.

FIG. 10 illustrates another cross-section of the modular insulation panel, taken from a side view of the auxiliary panel assembly.

DETAILED DESCRIPTION OF THE PREFERRED EMBODIMENTS

Figure 2:
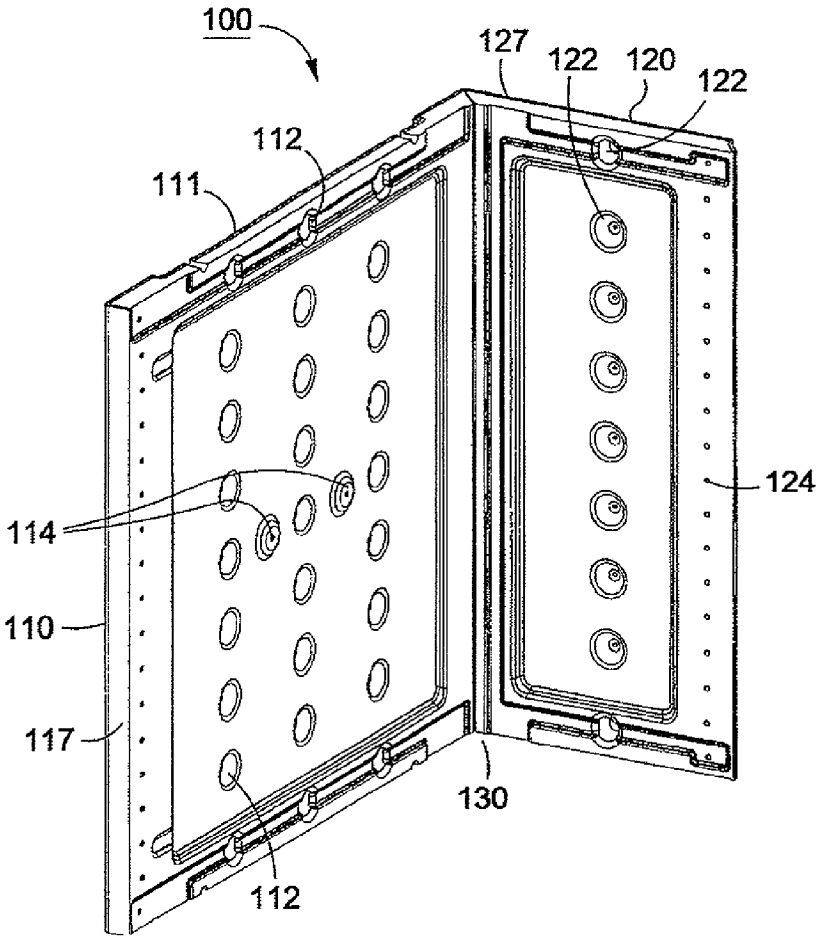
FIG. 2 illustrates another perspective view of the modular insulation panel.
Figure 1:
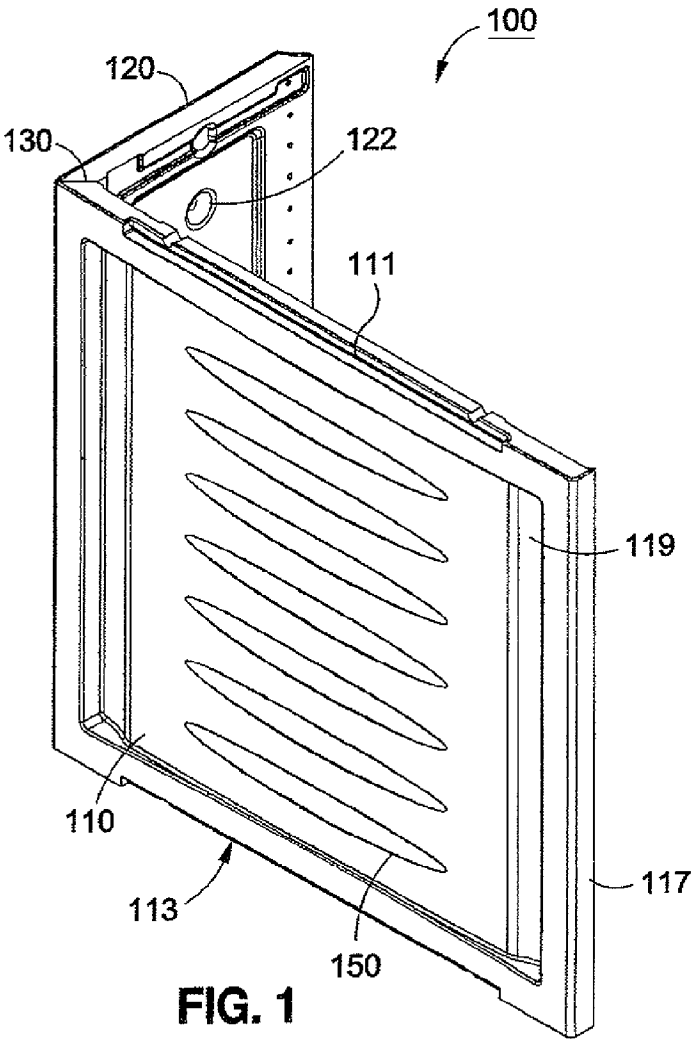
FIG. 1 illustrates a perspective view of a modular insulation panel in accordance with one embodiment of the present invention.

FIG. 1 illustrates a perspective view of a modular insulation panel, and FIG. 2 illustrates a perspective view of the modular insulation panel rotated about 90° clockwise from the view of FIG. 1. In this regard, FIG. 1 illustrates more of the outer side of the panel that would be visible to an observer of the cabinet, whereas FIG. 2 illustrates more of the inner side of the panel which would contact the holding cabinet.

Briefly, modular insulation panel 100 is comprised of main panel assembly 110, auxiliary panel assembly 120, and hinge 130. In a preferred embodiment, the entire modular insulation panel 100 is formed as one piece, for example by molding. In other words, while main panel 100 is comprised of main panel assembly 110, auxiliary panel assembly 120, and hinge 130, it is preferred that the entire panel is manufactured at the same time and as a single piece.

Main panel assembly 110 is connected to auxiliary panel 120 by hinge 130. Hinge 130 flexes inwardly such that the angle between main panel assembly 110 and auxiliary panel assembly 120 is reduced, forming the 90° angle between main panel assembly 110 and auxiliary panel assembly 120.

Main panel assembly 110 is comprised of a double wall structure 117 with a space 118 therebetween, and plural tack-offs 112 are provided between the double walls of double wall structure 117 for providing rigidity to the main panel assembly 110. A frame 119 runs around the outer wall of main panel assembly 110 near the edge of the main panel assembly. The space 118 between the inner and outer walls of the double wall structure 117 may be filled substantially with air, or may be filled at least in part by an insulating material.

As used in this description, "tack-off" refers a point or location where the inner and outer wall of the double wall approach each other or fuse together, such that there is less space or no space between the inner and outer walls of the double wall structure at the tack-off. Tack-offs can take many shapes. Some of the more common shapes are truncated cones or pyramids. Typically, it is preferable to have as much taper on the tack-off as possible, and to have a small contact area, such that there are not dimples or other marks on the visible exterior of the panel. Other variations on the dimensions and characteristics of tack-offs are of course possible.

In a preferred embodiment, the inner and outer walls of the panel are fused at the location of a tack off, in order to provide increased rigidity, as well as providing spacing between the inner and outer walls. In another embodiment, however, the walls may simply contact, if rigidity and other structural factors are not an issue. Such an embodiment would still provide spacing between the inner and outer walls of a panel, but would be less effective in increasing the rigidity of the panel.

Thus, the tack-offs are used to provide rigidity to a panel assembly. In particular, since main panel assembly 110 and auxiliary panel assembly 120 may be comprised of plastic or another lightweight material, and since the space between the inner and outer walls of the double walled structure of the panels may be filled with air (or another lightweight material), the panel may otherwise be less rigid than desired. Moreover, without tack-offs to space the inner and outer walls, the inner and outer walls of the panel may bounce or collapse against each other, creating an undesirable "drum-heading" effect. Therefore, in one aspect, tack-offs are a means of reducing cost and weight, while still maintaining stiffness between the panels. Specifically, the tack-offs provide additional rigidity and strength to the panel and avoid "drum-heading", while still allowing these panels to be constructed of a lightweight material with little or no solid matter between the panel walls.

Main panel assembly 110 also includes upper recess 111 and lower recess 113, for stacking main panel assembly 110 onto other modular panel assemblies. In this regard, the respective recesses leave projections at the edge of the main panel assembly, which may be termed "mating feet". In more detail, upper recess 111 and lower recess 113 may aid in interlocking with other modular insulation panels to insulate taller cabinets, or to interlock with a bumper which can optionally be provided at the base of a cabinet. The interconnection between these various elements in an insulation system will be described in more detail below.

Additionally, main panel assembly 110 includes main panel bosses 114 or other receptor mountings. Main panel bosses 114 are indentations in the panel used for receiving fasteners (such as screws or nails) inserted through the cabinet to fix the main panel assembly to the cabinet. Main panel bosses 114 may be placed at various locations on main panel assembly 110, and are not limited to the positions shown in any of the figures. Of course, the number of main panel bosses, the dimensions (i.e., size, depth, etc.) of the main panel bosses and other attributes can be varied widely according to application or preference.

Additionally, ridges 150 may be added to the outer wall of main panel assembly 110 for aesthetic purposes, and for certain functional advantages such as providing grips for easier movement of the cabinet.

Auxiliary panel assembly 120 is connected to main panel assembly 110. As discussed above, auxiliary panel assembly 120 is connected to main panel assembly 110 via hinge 130, and hinge 130 flexes inwardly such that main panel assembly 110 and auxiliary panel assembly 120 meet, forming a 90° angle.

Generally, auxiliary panel assembly 120 is comprised of a double wall structure 127 with a space 128 therebetween, and plural tack-offs 122 are provided between the double walls of double wall structure 127 for providing rigidity to the auxiliary panel assembly 120. A frame 129 runs the outer wall of auxiliary panel assembly 120 near frame 130. The space 128 between the inner and outer walls of the double wall structure 127 may be filled substantially with air, or may be filled at least in part by an insulating material.

Auxiliary panel assembly 120 also includes auxiliary panel bosses 124 or other receptor mountings for attaching auxiliary panel assembly 120 to the back wall of a cabinet. These mountings may be of a similar nature as main panel bosses 114, or may be different dimensions as desired.

As with main panel assembly 110, auxiliary panel assembly 120 may include ridges 150 for aesthetic or other purposes.

Hinge 130 attaches the frame of main panel assembly 110 to the frame of auxiliary panel assembly 120. Although a number of possible hinges could be used, in a preferred embodiment, hinge 130 is a living hinge. A living hinge is a hinge with little or no moving parts, and generally is a thin section of material that bends to allow movement. In a preferred embodiment, hinge 130 is comprised of a plastic with increased fatigue resistance to accommodate repeated bending of the hinge.

As discussed above, hinge 130 bends inwardly, in order to allow main panel assembly 110 and auxiliary panel assembly 120 to meet, such that main panel assembly 110 and auxiliary panel assembly 120 form an angle near or at 90°. This function allows the modular insulation panel 100 to wrap around the side of a holding cabinet to the back of the holding cabinet, in a process that will be described in more detail below. In one embodiment, hinge 130 may be constructed such that when closed, the hinge extends across the full length of the interface between the lateral side wall and the back wall of a cabinet. In another embodiment, the hinge may not extend across the full length of this interface.

Figure 3:
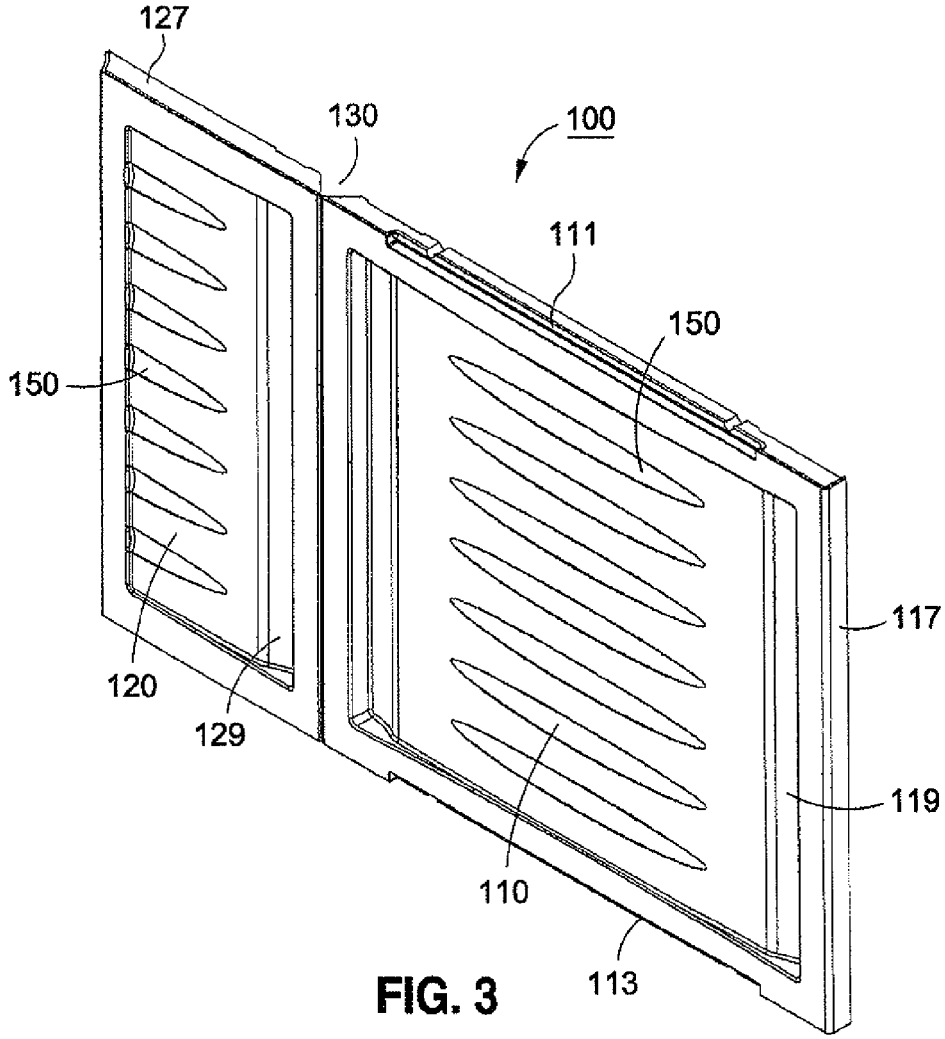
FIG. 3 illustrates a perspective view of the modular insulation panel in which the modular insulation panel lies substantially flat.

Additionally, hinge 130 may also be configured such that main panel assembly 110 and auxiliary panel assembly 120 lie flat, such as for easier storage and transportation. An example of this configuration is shown in FIG. 3. In this regard, manufacturing a living hinge which can also lie flat may allow for the respective parts of modular insulation panel 100 to be processed via blow-molding with less scrap material, simpler and less expensive tooling, and more consistent wall sections. This process will be explained in more detail below.

Of course, other hinge designs are possible depending on the particular needs of the consumer. For example, it may be possible to reverse the design of the hinge so that it bends 90° outwardly in the opposite direction. Put another way, using the view of FIG. 1, in this alternative embodiment auxiliary panel 120 would end up 180° from its position in FIG. 1, such that auxiliary panel 120 is pointed at the viewer instead of away from the viewer. This would result in a sharp inside corner, but leave a large 45° chamfer on the outside corner. Another possible way to achieve this effect would be to use two hinge points, each bending 45°. Of course, several variations are possible in addition to these examples.

Moreover, although hinge 130 is illustrated in the drawings and described herein, it should be realized that numerous methods and variations on the attachment of main panel assembly 110 and auxiliary panel assembly 120 are possible, including those without the use of a hinge. For example, main panel assembly 110 and auxiliary panel assembly 120 could be separate pieces, and each piece could be bolted or screwed on individually. In another embodiment, an adhesive could be used to attach individual panels, without a hinge at the corner. In still another embodiment the panel assemblies could be clamped or bracketed to the cabinet. It might also be possible to manufacture an entire panel assembly as a single piece, and then to slide or arrange the cabinet within the panel assembly. Numerous other embodiments and options are possible.

Modular insulation panel 100 may be formed from a number of materials, and preferably is molded as a single piece including constituent elements main panel assembly 110, auxiliary panel assembly 120 and hinge 130. Additionally, it is preferred that these elements are formed from the same materials using the same process. More specifically, in a preferred embodiment, modular insulation panel 100 is comprised of a plastic such as a high-density polyethylene. Other possible materials include polypropylene or acrylonitrile butadiene styrene (ABS), as well as some engineering-grade resins. While the respective inner and outer walls of the double wall structures 117 and 127 of main panel assembly 110 and auxiliary panel assembly 120 may be comprised of the same material, it may also be possible to construct the inner and outer walls from different materials. For example, an inner wall of each double wall structure could be comprised of a material more resistant to heat than the material of the outer wall of the double wall structure, or vice versa.

In addition, various manufacturing techniques may be used to form modular insulation panel 100, including blow molding, rotational molding, and injection molding (gas-assisted or regular). However, in a preferred embodiment, the method of manufacture is blow molding.

In more detail, blow molding is a process in which melted plastic is extruded into a hollow tube typically referred to as a parison. A divided metal mold then closes around the parison and the plastic, and air is blown into the parison, inflating the plastic into the shape of the metal mold. Once the plastic has cooled sufficiently, the metal mold opens, and the finished component is released. Thus, in regards to the present invention, a panel-shaped metal mold may be used. This process may require modifications on the parison or configuration of the molding apparatus, but the general principle is the same.

As noted above, using a living hinge which can also lie flat allows for the respective parts of modular insulation panel 100 to be processed via blow-molding with reduced scrap material and simpler and less expensive tooling, and allows for more consistent wall sections. In more detail, it may be easier and simpler to mold a single flat piece, rather than one with angles or bends. In particular, molding the modular insulation panel at the angle to fit to the cabinet could be much more difficult, since the tooling and molding would have to account for the angle between the panels and the increased area taken up by the panels at this angle, among other possible difficulties.

In the case where the inner and outer walls of modular insulation panel 100 are made of different materials, different manufacturing methods may be preferred. For example, one possible method is twin-sheet thermoforming. Thermoforming is basically the process of heating a sheet of plastic until it is pliable then forcing it into a mold (either positive or negative by pressure or vacuum) to create the desired shape and cool the sheet. The materials can have different characteristics and are fused where the meet at the perimeter of the part.

Of course, other manufacturing techniques are possible. For example, rotational molding is a process in which a measured quantity of polymer is loaded into a mold, usually in powder form. The mold is then heated in an oven while it rotates, until all of the polymer has melted and adhered to the mold wall. The mold is then cooled, and the plastic part is removed from the mold. Thus, rotational molding is useful in the manufacture of mostly hollow parts, and accordingly could be used to manufacture modular insulation panel 100 in one embodiment of the present invention.

Injection molding is a common manufacturing technique in which molten plastic is injected at high pressure into a mold which is shaped in the inverse of the product's desired shape. The mold then opens and the product is ejected. Again, modifications on the process might be necessary or desired for production of modular insulation panel 100, but the general principles would remain the same.

As a further consideration, the preferred material for manufacture may depend on which manufacturing process is chosen.

In a preferred embodiment, the thickness of the each respective inner and outer wall of main panel assembly 110 and auxiliary panel assembly 120 is about 0.100 inches, although variation due to manufacture is possible. Moreover, other desired thicknesses are possible based on characteristics of the heating cabinet such as size or heat output. Additionally, the desired thickness of the inner and outer walls may vary based on the particular plastic or material used to mold the wall, as well as the method of manufacture.

The dimensions of modular insulation panel 100 are sized to the target cabinet. Thus, main panel assembly 110, auxiliary panel assembly 120 and hinge 130 may be manufactured to different dimensions depending on the dimensions of the cabinet. For example, main panel assembly 110 or auxiliary panel assembly 120 could be constructed to different dimensions to accommodate taller or wider (or shorter or thinner) holding cabinets or containers of varying sizes, or could be constructed with additional distance between the inner and outer walls to provide more space for insulation.

In general, it is preferred that the panel be molded in such a way that the panel is easy to clean and aesthetically pleasing, as well as easy to assemble. In this regard, the manufactured panel walls and insulating space between may allow for reduced weight and costs of the panels, while still reducing the energy required to maintain temperature in a holding cabinet by up to 30% or more.

Figure 4:
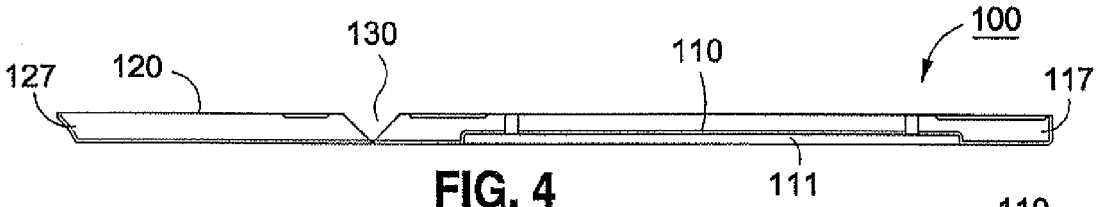
FIG. 4 illustrates a side elevational view of the modular insulation panel.

FIG. 3 depicts a perspective view of a modular insulation panel in a flat position. FIG. 4 illustrates a side elevational view of the modular insulation panel in the flat position, and FIG. 4A illustrates the hinge between the main panel assembly and auxiliary panel assembly in this position.

As seen in FIGS. 3 and 4, hinge 130 is not substantially bent, such that main panel assembly 110 and auxiliary panel assembly 120 lie flat. This configuration may be useful for storage or movement of the modular insulation panel 100 prior to attachment to a holding cabinet. For example, several modular insulation panels could be stacked flat in a box or other container, thus reducing the necessary amount of storage area. Thus, hinge 130 allows for main panel assembly 110 and auxiliary panel assembly 120 to lie flat, as well as bending to a right angle to wrap around a holding cabinet. As discussed above, the flat configuration may allow for processing via blow molding with reduced scrap material and simpler and less expensive tooling, and for more consistent wall sections.

Figure 4A:
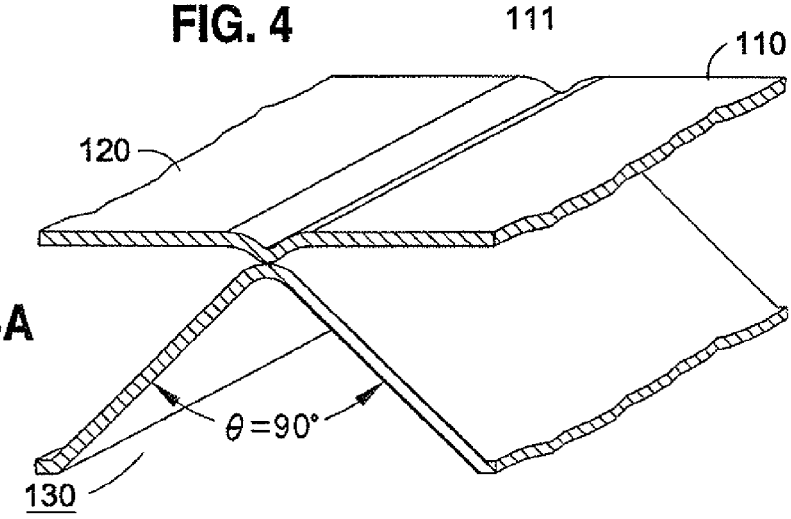
FIG. 4A illustrates a partially cutaway perspective view of a hinge of the modular insulation panel.

FIG. 4A depicts a partly cutaway perspective view of hinge 130 in more detail. As can be seen from the figure, hinge 130 runs along the entire height between main panel assembly 110 and auxiliary panel assembly 120, and essentially acts as the interface between these panels. Additionally, FIG. 4A depicts the preferred embodiment in which hinge 130 is a living hinge, as can be seen from the small amount of material in the center of the hinge which bends to allow movement. Additionally, when hinge 130 bends inward, the inner sides of main panel assembly 110 and auxiliary panel 120 meet along the width of the hinge, such that the respective panel assemblies contact each other at this line.

Figure 5:
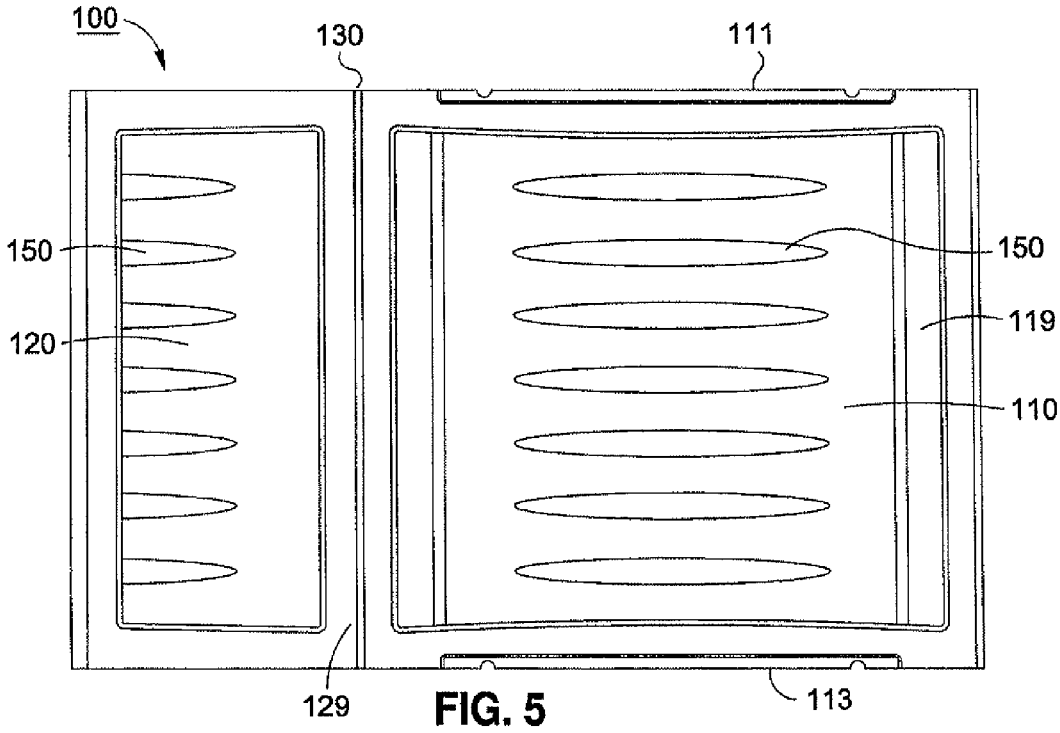
FIG. 5 illustrates a front elevational view showing the outer side of a modular insulation panel.
Figure 6:
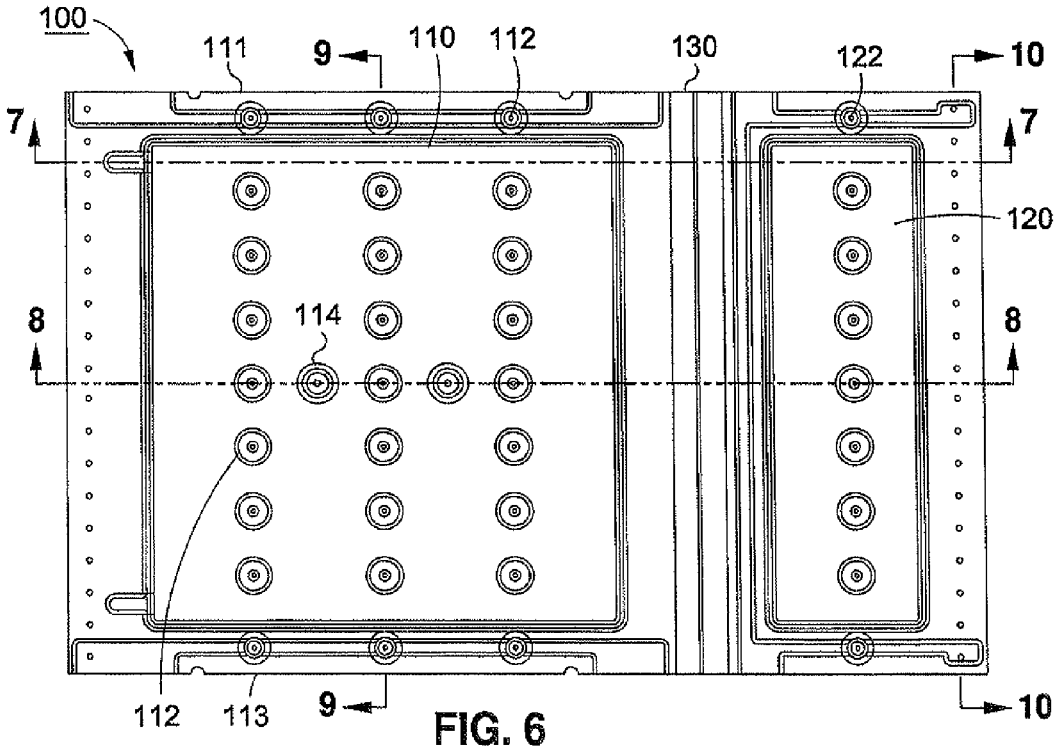
FIG. 6 illustrates a back elevational view showing an inner side of the modular insulation panel.

FIG. 5 depicts a front elevational view showing the outer side of a modular insulation panel which would be seen by an observer, and FIG. 6 illustrates a back elevational view showing an inner side of the modular insulation panel which would contact the cabinet. FIG. 6 additionally serves as a guide for locating the views (7), (8), (9) and (10), as indicated by the view lines in the drawings.

FIGS. 7 to 10 illustrate various cross-sections of modular insulation panel 100, taken respectively at the view lines (7), (8), (9) and (10) shown in FIG. 6. It can be seen that the space between the inner and outer wall of main panel assembly 110 and auxiliary panel assembly 120 is filled substantially with air. Additionally, the interior between the inner and outer walls of main panel assembly 110 and auxiliary panel assembly 120 near hinge 130 is also filled substantially with air, which may provide greater flexibility as the hinge 130 changes angle. However, it is also possible that another insulating material could be used to fill these spaces.

Additionally, the outer wall of main panel assembly dives steeply towards the inner wall near the edge of main panel assembly 110, and also near hinge 130. In other words, the outer wall indents into the inner wall, forming the recessed frame 119 which can be seen most clearly in FIGS. 1 and 3. This provides the frame 119 of the framed double wall structure 117 of main panel assembly 110. Auxiliary panel assembly 120 also has a similar indentation for the frame 129 of its double walled structure 127 near the location of hinge 130. While this frame design may be desired mainly for purposes of aesthetics, the thinner space between the inner and outer walls of main panel assembly 110 and auxiliary panel assembly 120 at the respective frames may provide for increased flexibility of hinge 130.

The inner and outer walls of the respective panel assemblies meet at tack-offs 112 and 122, such that there is not any space between the inner and outer walls at the location of the tack-off. As described above, it is preferred that the inner and outer walls of the panel are fused together at this location, such that there is no space between the inner and outer wall at the tack-off. Of course, other variations on the dimensions and size of the tack-offs are possible.

Fastener main panel bosses 114 extend almost completely through the space between the inner and outer walls of the double wall structure of main panel assembly 110, to provide a more secure attachment for attaching fasteners through the main panel assembly. In particular, since the mounting is deeper, more screw threads can be engaged. Of course, other dimensions or types of fastener receptor mountings could also be implemented, and as such are not described here further.

At the edges of main panel assembly 110, the material penetrates at a steeper angle, forming tack-offs at these locations.

A plurality of auxiliary panel bosses 124 are placed along the edge of the auxiliary panel assembly 120. The auxiliary panel bosses 124 are indentations or openings in the structure of the panel, and are used for receiving fasteners (such as screws or nails) inserted through the cabinet to fix the cabinet to the auxiliary panel assembly 120. The auxiliary panel bosses 124 may be placed at various locations on auxiliary panel assembly 120, and are not limited to the positions shown in the figures. Of course, the number of auxiliary panel bosses, the dimensions (i.e., size, depth, etc.) of the bosses and other attributes can be varied widely according to application or preference.

FIGS. 11 through 15 illustrate various views of a top panel, which is integral with one or more sets of modular insulating panels to provide insulation to the top of the cabinet, in addition to the insulation provided to the back and lateral side walls by the modular insulation panels.

Figure 13:
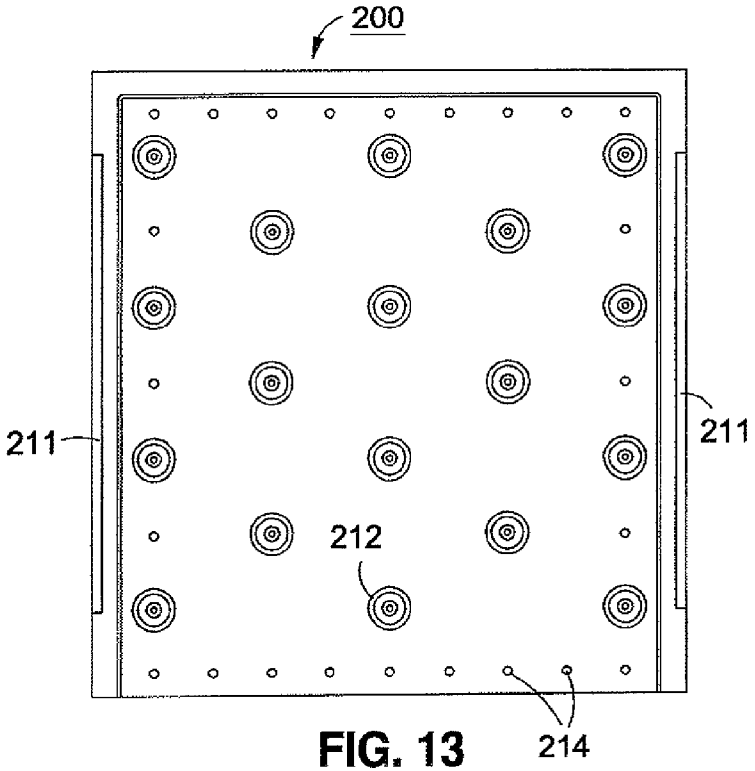
FIG. 13 illustrates an back elevational view of a top panel showing the inner side of the top panel.
Figure 11:
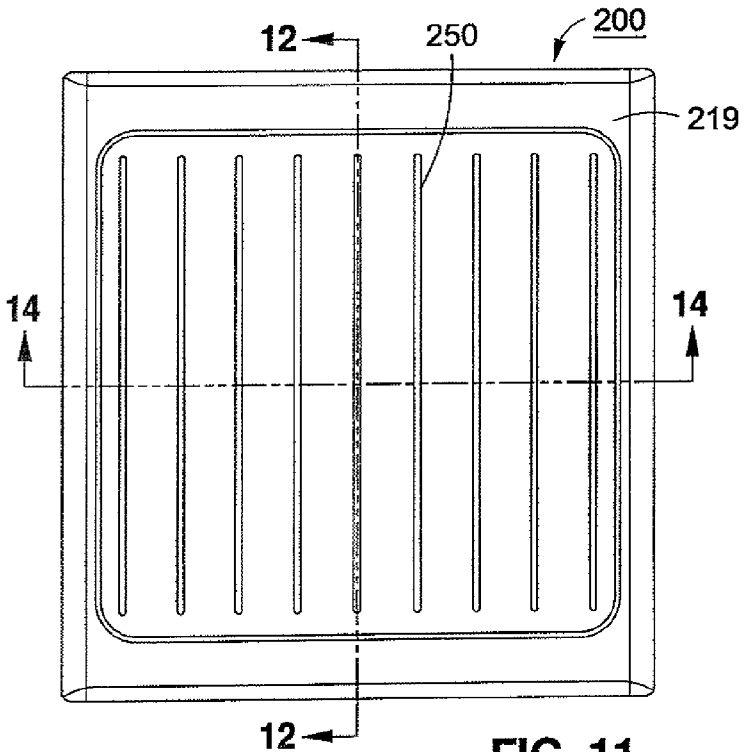
FIG. 11 illustrates a front elevational view of a top panel, showing the outer side of the top panel.
Figure 15:
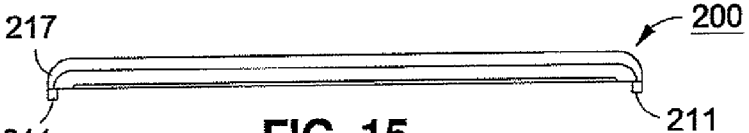
FIG. 15 illustrates a side elevational view of the top panel.
Figure 14:
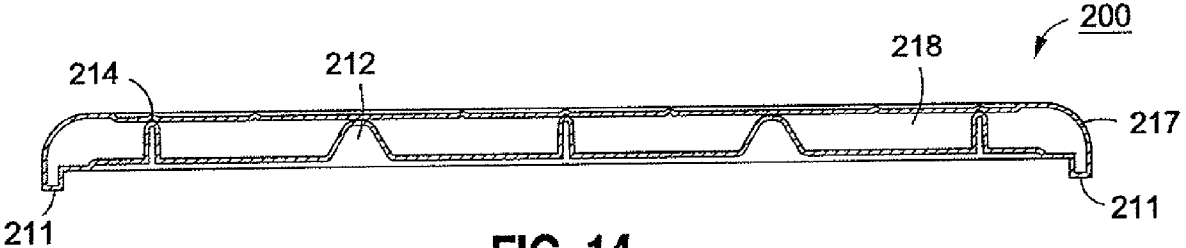
FIG. 14 illustrates another cross-section of the top panel.
Figure 12:
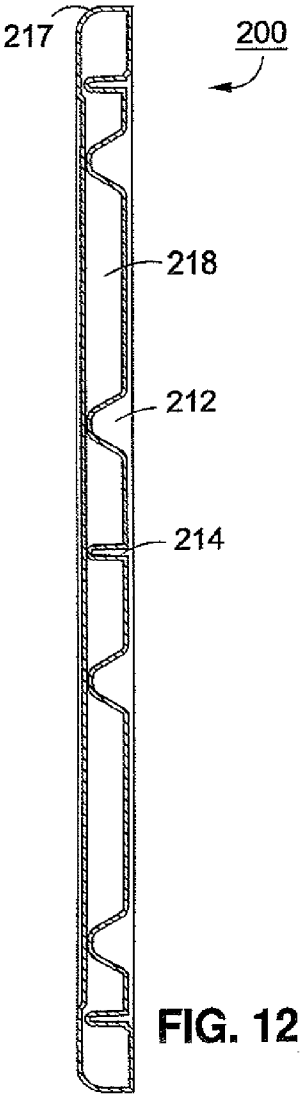
FIG. 12 shows a cross-section of the top panel.

FIG. 11 is an front elevational view of a top panel, showing the outer side of a top panel as would be seen from an observer of the holding cabinet. FIG. 13 illustrates an back elevational view of a top panel showing the inner side of the top panel which would contact the cabinet. FIG. 15 illustrates an side elevational view of a top panel. FIGS. 12 and 14 illustrate cross-sections of the top panel, at the view lines (12) and (14) shown in FIG. 11.

Top panel 200 is comprised of a double wall structure 217 with a space 118 therebetween, and plural tack-offs 212 are provided between the double walls of double wall structure 217 for providing rigidity to top panel 200. A frame 219 runs around the outer wall of near the edge of top panel 200. The space 218 in between the inner and outer walls of the double wall structure 217 may be filled substantially with air, or may be filled at least in part by an insulating material.

The tack-offs 212 are locations where the inner and outer walls of the double wall structure 217 meet. In a preferred embodiment, the inner and outer walls of the panel are fused at the location of a tack off, in order to provide increased rigidity and strength to the panel, as well as providing spacing to prevent unwanted "drum-heading" or contact between the inner and outer walls. In another embodiment, however, the walls may simply contact, if rigidity and other structural factors are not as much of an issue.

Top panel bosses 214 extend almost completely through the space between the inner and outer walls of the double wall structure of top panel 200, to provide a more secure attachment when attaching fasteners through the cabinet to top panel 200. Specifically, as noted above, the deeper insert allows for more fastener threads to be engaged.

Of course, many variations on the location and number of tack-offs 212 and top panel bosses 214 are possible. Additionally, receptor mountings other than bosses may be used.

Panel overhangs 211 can be seen on two sides of top panel 200. These panel overhangs are used to interconnect top panel 200 to modular insulation panels 100. In particular, each panel overhang 211 of top panel 200 interlocks with a respective top recess 111 to connect the modular insulation panel 100 and top panel 200, such that both the lateral side walls and the top wall of a cabinet may be insulated. The panel overhang 211 also may provide a desired aesthetic to the insulation system, since much of the interconnection between modular insulation panel 100 and top panel 200 is hidden by panel overhang 211. In this regard, in a preferred embodiment each of the (two) panel overhangs 211 would respectively integrate with a modular insulation panel 100, such that each overhang connects to a respective modular insulation panel. This is because in a preferred embodiment, two modular insulation panels 100 are used to cover both of the lateral side walls and the back wall of a holding cabinet. This assembly will become more clear in view of additional figures and will be described in more detail below.

In a preferred embodiment, only the sides of top panel 200 which interlock with the main panel assembly 100 of modular insulation panel 100 have panel overhangs 211. In other words, in a preferred embodiment, only the sides of top panel 200 which meet with the lateral side walls of a holding cabinet have panel overhangs 211. However, a top panel could be constructed in which three or more sides of the top panel have panel overhangs.

Top panel 200 may also include ridges 250 on the outer side. These ridges may serve several purposes. For example, ridges 250 may serve to raise objects placed on top of the cabinet above the main surface. Additionally, the recess around ridges 250 could possibly be used to mount or locate a metal inlay for supporting hot objects. Ridges 250 may also provide a grip for easier movement of the cabinet. Moreover, ridges 250 may improve the aesthetics of the panel assembly.

Top panel 200 is preferably formed using the same materials and the same manufacturing method as used to form modular insulation panel 100. Thus, in a preferred embodiment, top panel 200 is a high-density polyethylene, although other possible materials include polypropylene or acrylonitrile butadiene styrene (ABS), and certain resins. Additionally, while the inner and outer walls of the double wall structure 217 of top panel 200 may be comprised of the same material, it may also be possible to construct the inner and outer walls of top panel from different materials. For example, an inner wall of the double wall structure 217 could be comprised of a material more resistant to heat than the material of the outer wall of the double wall structure, or vice versa. If desired, top panel 200 may be comprised of a material different than that of modular insulation panel 100.

In addition, various manufacturing techniques may be used to form top panel 200, including blow molding, rotary molding, and injection molding (gas-assisted or regular). Sample methods were described above in respect to modular insulation panel 100, and therefore will not be described again. In this regard, top panel 200 can of course be manufactured by a method different from that of modular insulation panel 100.

As with modular insulation panel 100, dimensions of modular insulation panel 100 are sized to the target cabinet. Thus, top panel 200 may be manufactured to different dimensions depending on the dimensions of the cabinet. For example, top panel 200 could be constructed to different dimensions to accommodate taller or wider (or shorter or thinner) holding cabinets or containers of varying sizes, or could be constructed with additional distance between the inner and outer walls to provide more space for insulation. Of course, in a preferred embodiment the dimensions of top panel 200 are sized to the dimensions of the set of modular insulating panels 100, and all such panels are sized to the dimensions of the particular cabinet.

Figure 16:
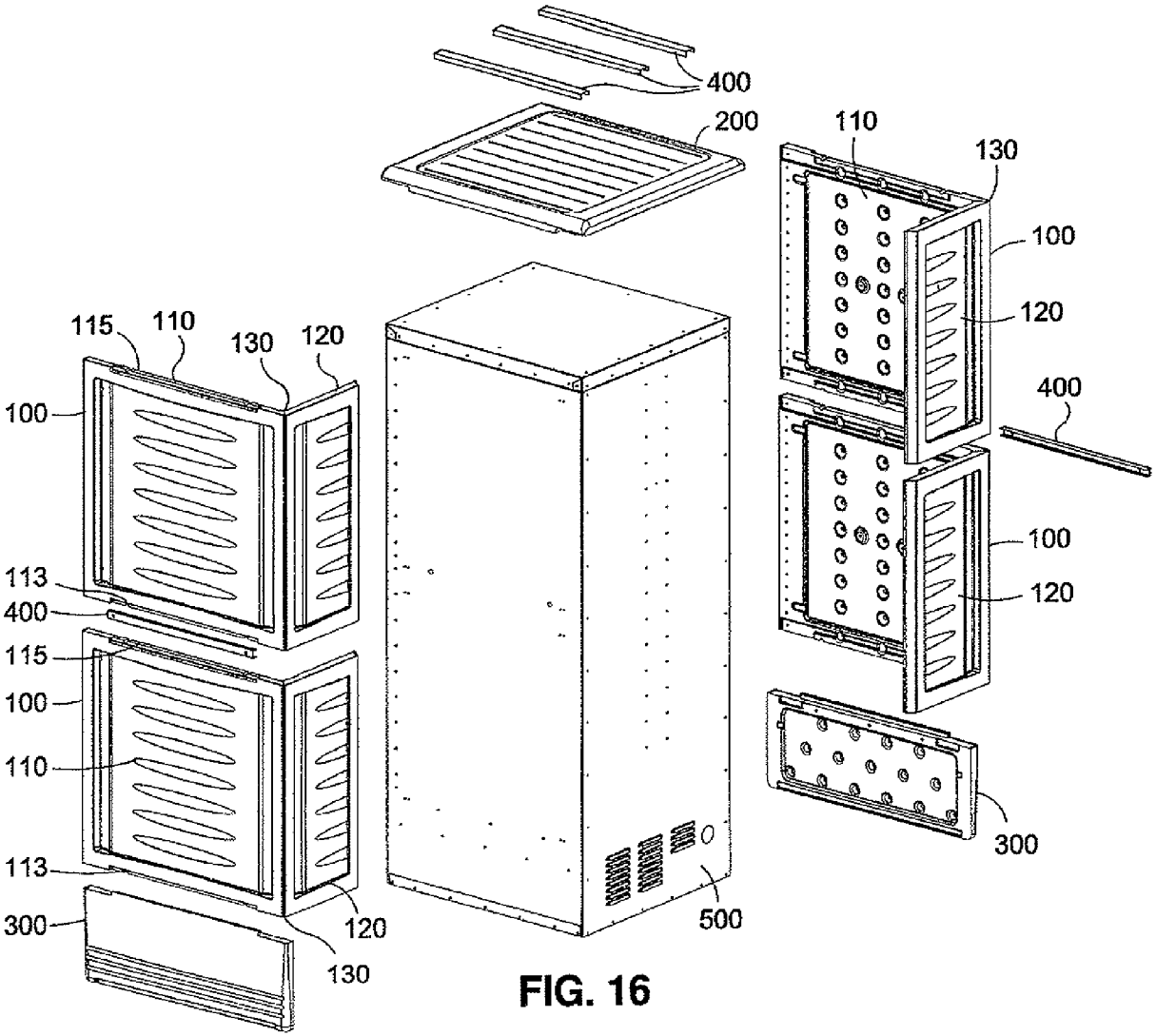
FIG. 16 depicts an exploded view of the exterior of a holding cabinet and a modular insulation system in accordance with one embodiment of the present invention.
Figure 18:
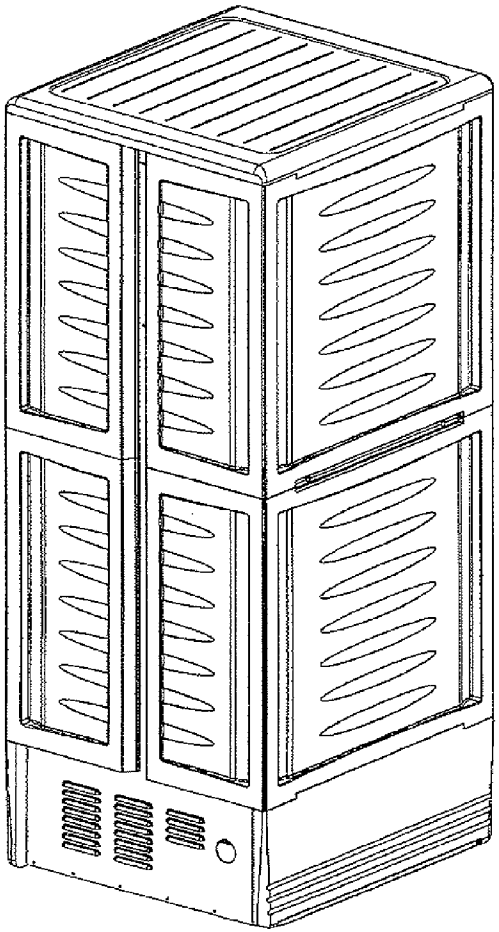
FIG. 18 illustrates another perspective view of the cabinet equipped with the modular insulation system.
Figure 17:
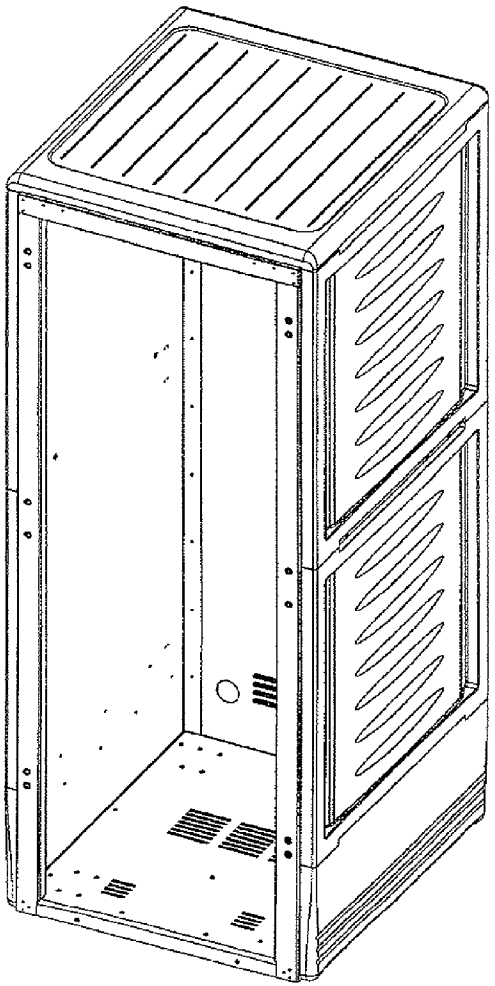
FIG. 17 illustrates a perspective view of a cabinet equipped with a modular insulation system in accordance with one embodiment of the present invention.

FIGS. 16 to 19 illustrate a modular insulation system in accordance with one embodiment of the present invention. The modular insulation system combines four modular insulation panels and a top panel, along with optional elements such as bumpers and channel brackets. FIG. 16 depicts an exploded view of the exterior of a holding cabinet and a modular insulation system in accordance with one embodiment of the present invention. FIGS. 17 and 18 show two perspective views of a cabinet 500 equipped with a modular insulation system of the present invention. For purposes of simplicity in regards to FIGS. 16 to 18, holding cabinet 500 will be described as "the cabinet", although only the exterior of the holding cabinet is illustrated in these figures.

Briefly, four modular insulation panels 100 attach to holding cabinet 500. As can be seen from the figure, one pair of left and right modular insulation panels 100 covers the holding cabinet laterally. In particular, using the hinge 130, each modular insulation panel 100 wraps around the holding cabinet, and the respective auxiliary panels 120 of each modular insulation panel 100 meet in the center of the back wall of the holding cabinet.

However, a second set of modular insulation panels are also included in the embodiment shown. This is to accommodate the taller cabinet 500 vertically. More specifically, the height of a holding cabinet may be such that it is preferred to stack pairs of modular insulation panels vertically in order to achieve the desired insulation coverage. The pairs of modular insulation panels 100 interlock vertically, such that any gap in vertical coverage is reduced. In another embodiment, the cabinet may be short enough that only one pair of modular insulation panels is required. Of course, several variations are possible between the height of the panels and the number of panels required, based on the size of the holding cabinet 500 and the desired coverage. To insulate the top of the cabinet, top panel 200 is provided, and top panel 200 interfaces with the upper set of modular insulation panels.

A modular insulation system may also include bumpers 300. Bumpers 300 are an optional accessory to the modular insulation system, and provide extra insulation and protection to the base of the cabinet. The bumper 300 may be constructed such that each lower recess 113 of the lower set of modular insulation panels 100 interfaces with the top of bumper 300, and the modular insulation panels rest on the bumpers. In this regard, lower recess 113 can also be used to interface with another modular insulation panel 100, as in the case of the upper set of modular insulation panels.

In more detail, a bumper 300 may comprise a double wall structure with a space therebetween for providing insulation to the base of the bottom wall, and plural tack-offs are provided between the double walls for providing rigidity to the bumper. Thus, the structure of bumper 300 may be similar to that of main panel assembly 110 and auxiliary panel assembly 120. However, bumper 300 may also be a solid piece, or mostly hollow, or any number of other variations. Bumper 300 may be constructed of a plastic or other material as described above, and the methods of construction may also vary as described above. Accordingly, these characteristics of bumper 300 will not be described in detail.

Main panel bosses 114, auxiliary panel bosses 124, and top panel bosses 214 are used to attach the respective panels to holding cabinet 500. In particular, screws, nails, or other fasteners are inserted through cabinet 500 into the bosses to attach the cabinet to the panels. In this regard, although an embodiment using hinged panels and fasteners is shown in FIG. 16, numerous methods of attaching the modular insulation panels are possible. For example, as described above, each piece could be bolted or screwed on individually, or an adhesive could be used to attach individual panels, or the panel assemblies could be clamped or bracketed to the cabinet. It might also be possible to manufacture an entire panel assembly as a single piece, and then to slide or arrange the cabinet within the panel assembly.

In the embodiment of FIG. 16, channel brackets 400 are placed at each interface between two modular insulation panels. More specifically, channel brackets 400 also cover the interface between the main panel assemblies 110 of the respective upper and lower modular insulation panels 100, as well as the seam between the auxiliary panel assemblies 120 of the left and right modular insulation panels. The channel brackets 400 may then be placed at the seams to provide further protection or cleanability, as well as covering the interfaces between the panels.

Additionally, channel brackets 400 may be attached on top of top panel 200. In such an embodiment, channel brackets 400 could also be used to support objects above the top surface of the cabinet, such as hot trays. Again, numerous variations in the method and hardware for attachment are possible.

In one aspect, a combination of the interlocking panels with the channel brackets 400 may help to reduce the gaps formed at joints and seams of panel interfaces, leading to reduced build-up of dirt and other particles. This may in turn may reduce the need for silicone or other sealants to close these gaps. In addition, certain molding techniques may have size variation inherent in the process, and this embodiment allows for these differences while still reducing the gaps between the panels. However, channel brackets 400 are not required to practice the invention.

As mentioned above, the modular insulation panels 100 are constructed to interface with each other, with top panel 200, and optionally with bumpers 300. In more detail, upper recess 111 can interface with either top panel 200 (as in the case of upper pair of modular insulation panels) or another modular insulation panel 100 (as in the case of the lower set of modular insulation panels). Conversely, lower recess 113 can be constructed to interface with bumper 300 (as in the case of the lower insulation panels) or another modular insulation panel 100 (as in the case of the upper insulation panels). Thus, the interfaces between the panels allow for modular insulation by adding or subtracting pairs of modular insulation panels 100, and provide increased insulation to holding cabinet 500.

If desired, the auxiliary panel may also be constructed to interface with a top panel or other modular insulation panel in a similar manner.

As can be seen, the modular insulation system provides insulation to the majority of the cabinet, except in the places where insulation may not be desired, such as the front of the cabinet where the door is placed, and the base of the back wall of the cabinet, where exhaust ports or other mechanical or electrical equipment may be located.

Figure 19:
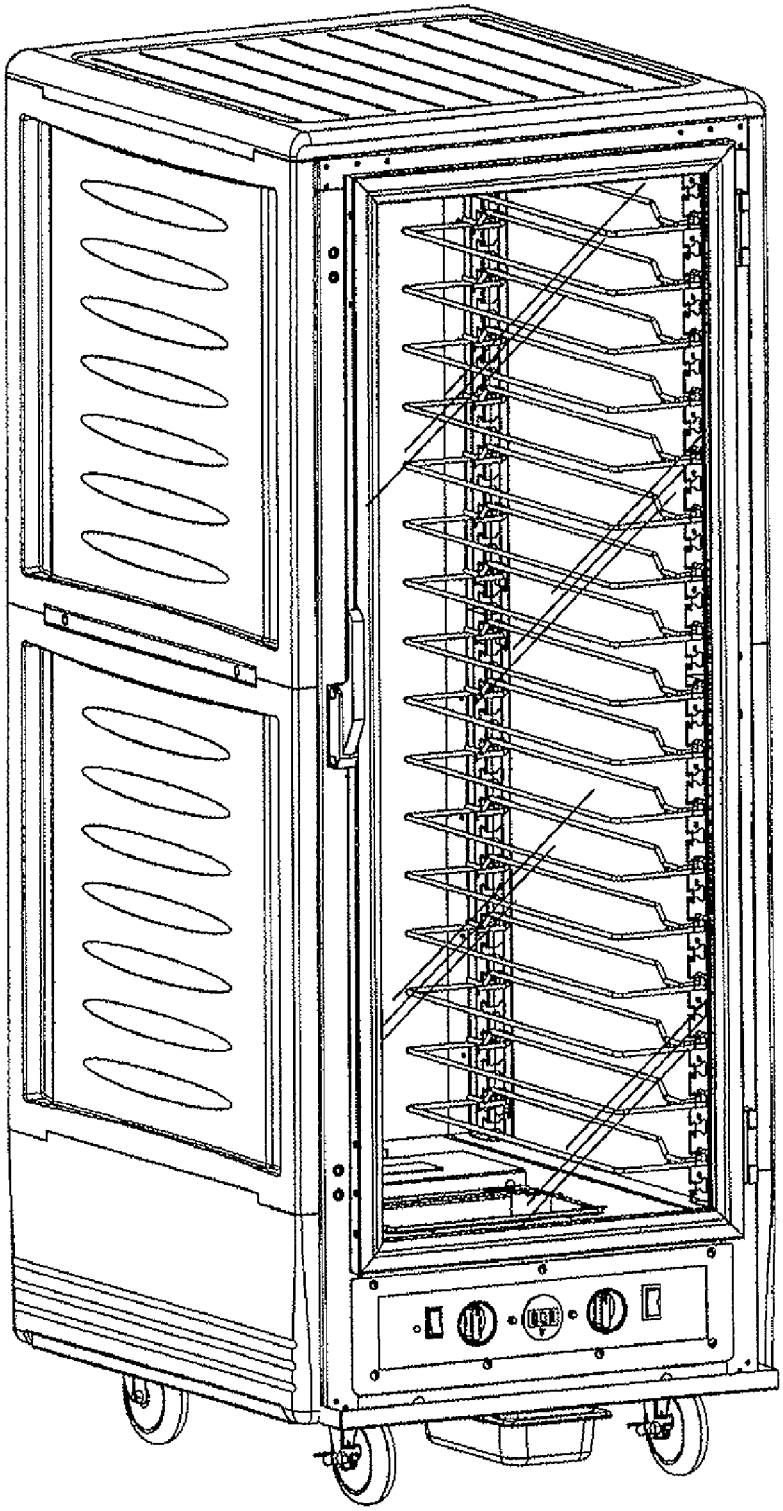
FIG. 19 illustrates one environment in which the present invention may be practiced.

FIG. 19 illustrates an example embodiment of the present invention in which a full holding cabinet is illustrated. The structural and operational features of the holding cabinet shown can vary widely as appropriate to the given application. In particular, such cabinets may be constructed with varying height, width, or depth. For example, cabinets may be constructed to be one-half or three-quarters the size of the cabinet shown FIG. 1, as well as numerous other variations.

While the present invention has been described with a food service cabinet in mind, the present invention is not limited to such or to food service applications, but could be used for other types of containers, in commercial or non-commercial settings. The invention may also be modified to accommodate non-food service applications.

The foregoing provides an uninsulated cabinet with insulation. Moreover, the expense on the consumer may be reduced, and additional options in cabinet purchase may be made available to the consumer. It may also be possible to reduce the energy consumption of the cabinet, since the insulating walls may reduce the amount of heat (or cold) lost from the cabinet interior. Furthermore, it may be possible to replace or update panels in the field that are already in usage, as well as adding or subtracting panels if the consumer's needs change or damage occurs to an original set of panels. Additionally, it may also be possible to reduce wear and tear on the cabinet walls, since the panels cover portions of the cabinet which would otherwise be exposed.

One of ordinary skill in the art will realize that modifications and variations, including but not limited to those discussed above, are possible within the spirit and scope of the present invention. The invention is intended to be limited in scope only by the accompanying claims, which should be accorded the broadest interpretation so as to encompass all such modifications, equivalent structures and functions.

The invention claimed is:

1. A modular insulation panel for insulation of a cabinet having lateral side walls, a back wall and a top wall, comprising:

a main panel assembly adapted to insulate a lateral side wall, said main panel assembly comprised of a double wall structure having a frame, an inner wall and an outer wall, with a space between said inner and outer walls for providing insulation to the lateral side wall;

an auxiliary panel assembly adapted to insulate the back wall, said auxiliary panel assembly comprised of a double wall structure having a frame, an inner wall and an outer wall, with a space between said inner and outer walls for providing insulation to the back wall;

a plurality of main panel bosses for attaching the main panel assembly to the cabinet, wherein the plurality of main panel bosses are arranged in a region interior to the frame of the main panel assembly, and wherein the main panel bosses are indentations extending from the inner wall to the outer wall of the main panel assembly for receiving fasteners inserted through the cabinet to fix the modular insulation panel to the cabinet; and a living hinge for hingedly attaching the frame of the main panel assembly to the frame of the auxiliary panel assembly, wherein the living hinge has two hinge points, wherein an inner wall of each wall structure is comprised of a different material than an outer wall of the wall structure.

2. The modular insulation panel of claim 1, wherein the main panel assembly further comprises plural tack offs between the inner and outer walls for providing rigidity to the main panel.

3. The modular insulation panel of claim 1, wherein the auxiliary panel assembly further comprises plural tack offs between the inner and outer walls for providing rigidity to the auxiliary panel.

4. The modular insulation panel of claim 1, wherein the space between the inner and outer wall of each wall structure is filled substantially with air.

5. The modular insulation panel of claim 1, wherein the space between the inner and outer wall of each wall structure is filled at least in part by an insulative material.

6. The modular insulation panel of claim 1, wherein the main panel assembly covers substantially all of the lateral wall.

7. The modular insulation panel of claim 1, wherein the auxiliary panel assembly covers substantially less than all of the back wall.

8. The modular insulation panel of claim 7, wherein the auxiliary panel assembly covers approximately one half of the back wall.

9. The modular insulation panel of claim 1, wherein the main panel assembly includes exterior recesses for mounting to other structures.

10. The modular insulation panel of claim 1, wherein the modular insulation panel is fabricated from plastic.

11. The modular insulation panel of claim 1, wherein the inner wall of each wall structure is comprised of a material more resistant to heat than the material of the outer wall of the wall structure.

12. A modular insulation system comprising:

the modular insulation panel of claim 1; and a cabinet, wherein the cabinet includes a heating element for providing heat to the cabinet.

13. A modular insulation system, comprising:

a pair of the modular insulation panels of claim 1;

a top panel comprised of a wall structure having a frame and an inner wall and an outer wall, with a space between said inner and outer walls for providing insulation to the top wall.

14. The modular insulation system of claim 13, wherein the top panel further comprises plural tack offs for providing rigidity to the top panel.

15. The modular insulation system of claim 13, wherein the frame of the main panel assembly is generally aligned with a face of the top panel.

16. The modular insulation system of claim 15, further comprising one or more bumpers for a base of the cabinet.

17. The modular insulation system of claim 16, wherein each bumper comprises a wall structure having an inner wall and an outer wall with a space therebetween for providing insulation to the base of the bottom wall, and plural tack offs between said inner and outer walls for providing rigidity to the bumper.

18. The modular insulation system of claim 13, further comprising:

a second pair of the modular insulation panels of claim 1 placed on top of the first pair of modular insulation panels, for insulation of taller cabinets.

19. The modular insulation system of claim 18, wherein exterior recesses are provided on each modular insulation panel for interfacing between the first and second pairs of modular insulation panels.

20. The modular insulation panel of claim 1, wherein the hinge flexes inwardly such that the angle between the plane of the main panel assembly and the plane of the auxiliary panel assembly is reduced.

21. The modular insulation panel of claim 1, wherein the hinge is constructed to bend up to 90° around the lateral side wall and back wall of the cabinet, and wherein the hinge is also constructed to lay flat.

22. The modular insulation panel of claim 1, wherein the hinge extends the full length of the interface between the lateral side wall and the back wall of the cabinet.

23. The modular insulation panel of claim 1, wherein the hinge does not extend the full length of the interface between the lateral side wall and the back wall of the cabinet.

24. A method of constructing a modular insulation panel for insulation of a cabinet having lateral side walls, a back wall and a top wall, comprising:

molding a main panel assembly adapted to insulate a lateral side wall, said main panel assembly comprised of a wall structure having a frame, an inner wall and an outer wall, with a space between said inner and outer walls for providing insulation to the lateral side wall;

molding an auxiliary panel assembly adapted to insulate the back wall, said auxiliary panel assembly comprised of a wall structure having a frame, an inner wall and an outer wall, with a space between said inner and outer walls for providing insulation to the back wall;

providing a plurality of main panel bosses for attaching the main panel assembly to the cabinet, wherein the plurality of main panel bosses are arranged in a region interior to the frame of the main panel assembly, and wherein the main panel bosses are indentations extending from the inner wall to the outer wall of the main panel assembly for receiving fasteners inserted through the cabinet to fix the modular insulation panel to the cabinet; and providing a living hinge for hingedly attaching the frame of the main panel assembly to the frame of the auxiliary panel assembly, wherein the living hinge has two hinge points, wherein an inner wall of each wall structure is comprised of a different material than an outer wall of the wall structure.

25. The method of claim 24, wherein the step of molding the main panel assembly further comprises molding plural tack offs between the inner and outer walls of the main panel assembly for providing rigidity to the main panel.

26. The method of claim 24, wherein the step of molding the auxiliary panel assembly further comprises molding plural tack offs between the inner and outer walls of the auxiliary panel assembly for providing rigidity to the auxiliary panel.

27. The method of claim 24, wherein each molding step comprises blow molding.

28. A method of insulating a cabinet having lateral side walls, a back wall and a top wall, comprising:

providing a pair of the modular insulation panels of claim 1;

providing a top panel integral with the pair of modular insulation panels and comprised of a wall structure having a frame and an inner wall and an outer wall, with a space between said inner wall and said outer wall for providing insulation to the top wall;

attaching the respective modular insulation panels to the lateral side walls and back wall of the cabinet; and attaching the top panel to the top wall.

29. An armored and insulated cabinet, comprising:

left and right lateral side walls, a back wall, and a top wall, a right main panel assembly attached to the right lateral side wall, said right main panel assembly comprised of a wall structure having a frame, an inner wall and an outer wall, with a space between said inner and outer walls, an right auxiliary panel assembly attached to the right side of the back wall, said right auxiliary panel assembly comprised of a wall structure having a frame, an inner wall and an outer wall, with a space between said inner and outer walls, wherein the frame of the right main panel assembly is attached to the frame of the right auxiliary panel assembly;

a left main panel assembly attached to the left lateral side wall, said left main panel assembly comprised of a wall structure having a frame, an inner wall and an outer wall, with a space between said inner and outer walls;

a left auxiliary panel assembly attached to the left side of the back wall, said left auxiliary panel assembly comprised of a wall structure having a frame, an inner wall and an outer wall, with a space between said inner and outer walls, wherein the frame of the left main panel assembly is attached to the frame of the left auxiliary panel assembly;

a plurality of left main panel bosses for attaching the left main panel assembly to the cabinet and a plurality of right main panel bosses for attaching the right main panel assembly to the cabinet, wherein the main panel bosses are arranged in a region interior to the frame of the respective main panel assembly, and wherein the main panel bosses are indentations extending from the inner wall to the outer wall of the respective main panel assembly for receiving fasteners inserted through the cabinet to fix the modular insulation panel to the cabinet;

a first living hinge for hingedly attaching the frame of the right main panel assembly to the frame of the right auxiliary panel assembly, and a second living hinge for hingedly attaching the frame of the left main panel assembly to the frame of the left auxiliary panel assembly, wherein each living hinge has two hinge points; and a top panel attached to the top wall and comprised of a wall structure having a frame and an inner wall and an outer wall, with a space between said inner and outer walls, wherein the left auxiliary panel assembly and right auxiliary panel assembly confront each other at the center of the back wall, wherein the top wall is generally aligned with the right main panel assembly, the left main panel assembly, the right auxiliary panel assembly and the left auxiliary panel assembly, and wherein an inner wall of each wall structure is comprised of a different material than an outer wall of each wall structure.

30. A modular insulation panel for insulation of a cabinet having lateral side walls, a back wall and a top wall, comprising:

a main panel assembly adapted to insulate a lateral side wall, said main panel assembly comprised of a double wall structure having a frame, an inner wall and an outer wall, with a space between said inner and outer walls for providing insulation to the lateral side wall; and an auxiliary panel assembly adapted to insulate the back wall, said auxiliary panel assembly comprised of a double wall structure having a frame, an inner wall and an outer wall, with a space between said inner and outer walls for providing insulation to the back wall;

a plurality of main panel bosses for attaching the main panel assembly to the cabinet, wherein the plurality of main panel bosses are arranged in a region interior to the frame of the main panel assembly, and wherein the main panel bosses are indentations extending from the inner wall to the outer wall of the main panel assembly for receiving fasteners inserted through the cabinet to fix the modular insulation panel to the cabinet; and a living hinge for hingedly attaching the frame of the main panel assembly to the frame of the auxiliary panel assembly, wherein the living hinge has two hinge points, wherein the outer wall of the main panel assembly and the outer wall of the auxiliary panel assembly each respectively include one or more ridges for providing graspable handles to the modular insulation panel.

31. The modular insulation panel of claim 1, wherein each hinge point of the living hinge bends up to 45°.

32. The method according to claim 24, wherein each hinge point of the living hinge bends up to 45°.

33. The cabinet of claim 29, wherein each hinge point of each living hinge bends up to 45°.

34. The modular insulation panel of claim 30, wherein each hinge point of the living hinge bends up to 45°.

* * * * *